United States Patent [19]

Gotoh et al.

[11] 4,438,627

[45] Mar. 27, 1984

[54] EXHAUST GAS PURIFICATION APPARATUS IN INTERNAL COMBUSTION ENGINE

[75] Inventors: Osamu Gotoh, Higashikurume; Akira Fujimura, Niiza, both of Japan

[73] Assignee: Honda Giken Kogyo Kabushiki Kaisha, Tokyo, Japan

[21] Appl. No.: 320,689

[22] Filed: Nov. 12, 1981

[30] Foreign Application Priority Data

Nov. 18, 1980 [JP] Japan ..... 55-161432

[51] Int. Cl.[3] ..... F01N 3/22

[52] U.S. Cl. ..... 60/278; 60/277; 60/290; 60/298

[58] Field of Search ..... 60/278, 290, 277, 298

[56] References Cited

U.S. PATENT DOCUMENTS 3,738,109 6/1973 Tatsutomi et al. .
3,751,916 8/1973 Hayashida et al. .
3,768,787 10/1973 Marsee ..... 60/278
3,888,080 6/1975 Nohira ..... 60/290
4,149,377 4/1979 Takagi et al. .
4,172,362 10/1979 Mizuno ..... 60/278
4,240,253 12/1980 Nakamura ..... 60/278

*Primary Examiner*—Douglas Hart
*Attorney, Agent, or Firm*—Armstrong, Nikaido, Marmelstein & Kubovcik

[57] ABSTRACT

An exhaust gas purification apparatus is provided for an internal combustion engine which comprises an intake passage means, an exhaust passage means, a catalyzer for exhaust gas purification which is coupled to an exhaust passage, and an external air introducing passage for introducing external air. The external air introducing passage is coupled to the exhaust passage on the upstream side of the catalyzer. A control valve is positioned in the external air introducing passage and a detecting device is coupled to said control valve for detecting a deceleration of the engine and for opening the control valve in response thereto. External air flows through the external air introducing passage and the control valve into the catalyzer for cooling said catalyzer.

6 Claims, 1 Drawing Figure

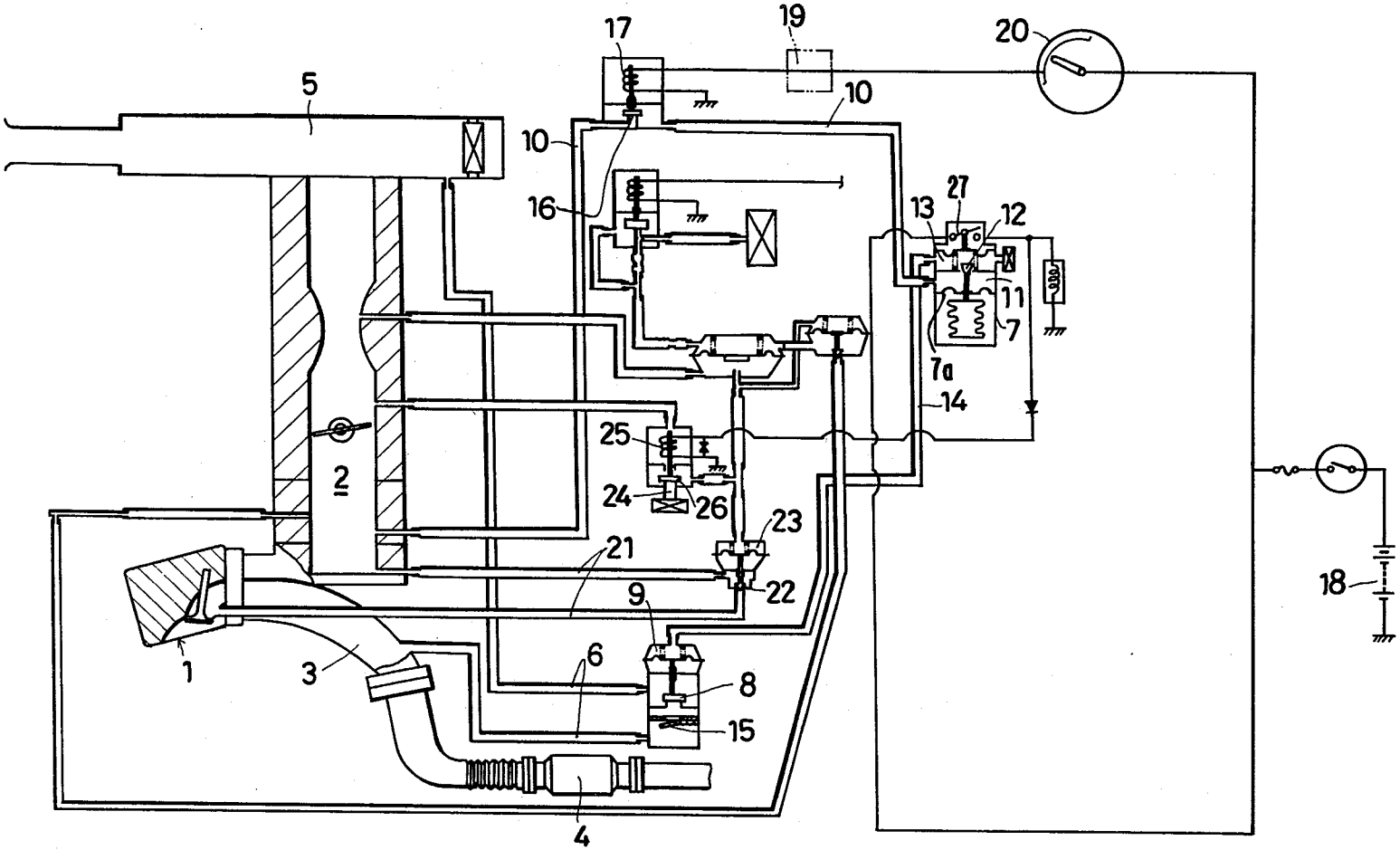
1
2
3
4
5
6
7
7a
8
9
10
10
11
12
13
14
15
16
17
18
19
20
21
22
23
24
25
26
27

EXHAUST GAS PURIFICATION APPARATUS IN INTERNAL COMBUSTION ENGINE

BACKGROUND OF THE INVENTION

1. Field of the Invention

This invention relates to a catalyzer type exhaust gas purification apparatus for use in a lean mixture combustion type internal combustion engine.

2. Description of the Prior Art

In prior art apparatus of this kind, a catalyzer or catalytic converter for exhaust gas purification is connected in an exhaust passage of a lean mixture combustion-type internal combustion engine. However, with this type of apparatus, when unburned components are increased in the exhaust gas during deceleration of the engine, a violent or rapid reaction takes place in the catalyzer and the catalyzer is liable to rise in temperature and exceed a critical temperature.

In the case of a lean mixture type internal combustion engine, a comparatively large amount of oxygen is always present in the exhaust gas so that when the unburned components are increased, the unburned components react violently or rapidly in the catalyzer in the presence of the oxygen. Thus, the catalyzer temperature is rapidly raised, which can result in damage.

SUMMARY OF THE INVENTION

It is the object of the present invention to provide an apparatus for cooling a catalyzer during engine deceleration.

It is another object of the present invention to provide an exhaust gas purification apparatus which includes means for automatically providing external air to a catalyzer during engine deceleration for cooling the catalyzer.

The present invention is directed to an exhaust gas purification apparatus for an internal combustion engine which comprises an intake passage means, an exhaust passage means, a catalyzer for exhaust gas purification which is coupled to an exhaust passage means and an external air introducing passage means for introducing external air. The external air introducing passage means is coupled to the exhaust passage means on the upstream side of the catalyzer. A control valve means is positioned in said external air introducing passage means, and detecting means are coupled to the control valve means for detecting a deceleration of the engine and for opening the control valve means in response thereto, and air flows therethrough into the catalyzer for cooling the catalyzer.

BRIEF DESCRIPTION OF THE DRAWING

The FIGURE is a schematic diagram of the preferred embodiment of the present invention.

DETAILED DESCRIPTION OF THE PREFERRED EMBODIMENT

Referring to the drawing, a lean mixture combustion type internal combustion engine 1 has an intake passage 2 and exhaust passage 3. An oxidation catalyzing type catalyzer or catalytic converter 4 for exhaust gas purification is positioned in the exhaust passage 3, and an air cleaner 5 is located at the upstream end of the intake passage 2.

An external air introducing passage 6 communicating between the interior of the passage 3 and the external air through the air cleaner 5 diverges from a portion of the exhaust passage 3 that is located on the upstream side of the catalyzer 4 and a control valve 8, positioned in the passage 6, is opened by the operation of a detecting means 7, which detects a deceleration of the engine 1.

The control valve 8 is a negative pressure responsive type valve which is opened if a negative pressure in a negative pressure chamber 9 is increased to a predetermined value, for instance, above −500 mmHg. The detecting means 7 includes a negative pressure responsive member 7*a*, such as a diaphragm or the like, provided in front of the negative pressure chamber 11 arranged to be supplied through a negative pressure passage 10 with an intake negative pressure generated on the downstream side of the intake passage 2 at the time of deceleration of the engine 1. Additionally, behind the negative pressure chamber 11, there is provided a second negative pressure chamber 13 which is in communication with the negative pressure chamber 11 through a valve 12 arranged to be opened by the operation of the negative pressure responsive member 7*a*. The chamber 13 is in communication with the negative pressure chamber 9 through a passage 14 so that if the intake negative pressure is increased, the same is introduced into the negative pressure chamber 9 through the negative pressure passage 10, the negative pressure chamber 11, the negative pressure chamber 13 and the passage 14 to open the control valve 8. Thereby, the external air is introduced into the exhaust passage 3 through the control valve 8. At this time, the introduction of the external air is carried out by utilizing an exhaust gas pulsation in the exhaust passage 3 and, for this purpose, a reed valve 15 is provided on the downstream side of the control valve 8.

The external air thus introduced is led to the catalyzer 4 on the upstream side of the exhaust passage 3 and acts to cool the same. However, the introduction of the external air is not necessary when the engine 1 is at a comparatively low rotation speed or a vehicle is at a comparative low speed because, under this condition, the temperature of the catalyzer 4 does not rise so rapidly as to be damaged.

In order to avoid providing cooling air when it is not needed, negative pressure passage 10 is provided with a valve 16 for opening and closing the same and a circuit is provided for connecting an operation solenoid 17 to an electric source 18 through an engine speed switch 19 arranged to be closed at a predetermined high engine speed, for instance, above 1500–2000 rpm, and a vehicle speed switch 20 arranged to be closed at a high vehicle speed, for instance, above 20 km/H. Thus only when the two stitches 19, 20 are both closed is the solenoid 17 operated to open the valve 16, and the negative pressure passage 10 is brought into an operable condition. Such a modification can be made with only one of the two switches 19 and 20 coupled in the circuit.

Additionally, the engine 1 is an exhaust gas return type engine. Namely, an exhaust gas return passage 21 connected to the intake passage 2 is diverged from the exhaust passage 3, and an exhaust gas return control valve 22 is connected in return passage 21 so that the exhaust gas return operation is carried out therethrough under normal conditions. But when the control valve 8 is closed, the control valve 22 is closed simultaneously therewith to stop the exhaust gas return operation. An external air introducing opening 24 communicates between the interior of a negative pressure chamber 23 located behind the control valve 22 and the exterior with a valve 26 arranged to be opened on energization of an operation solenoid 25. A circuit connected between the solenoid 25 and the electric source 18 is provided with a negative pressure switch 27, which is closed on an increase in the negative pressure in the negative pressure chamber 13. Thus, by the operation of the detecting means 7, the switch 27 is closed and the valve 26 is opened through the operation of solenoid 25 and the control valve 22 is closed, resulting in external air being supplied to the negative pressure chamber 23. The exhaust gas return operation is thus stopped on the deceleration of the engine 1.

The operation of the apparatus will now be explained as follows:

In an ordinary situation, the external air introducing passage 6 is in its inoperative condition with the control valve 8 closed. That is, there is no introduction of the external air therethrough in an ordinary situation. When the engine 1 is decelerated, unburned components in the exhaust gas are increased and, in accordance therewith, there is a rapid reaction in the catalyzer 4 and a rapid rise in temperature may occur. The present invention prevents this phenomenon. Namely, as a result of deceleration, the intake negative pressure is increased through the negative pressure passage 10 into the negative pressure chamber 11 to operate the front surface negative pressure responsive member. That is, the detecting means 7 is operated. Thereby, the valve 12 is opened and the negative pressure in the chamber 11 is introduced from the negative pressure chamber 13 through the passage 14 into the negative pressure chamber 9, causing the control valve 8 to open. External air introducing passage 6 is thus brought into its operative condition and, as a result, external air is introduced by the exhaust gas pulsation in the exhaust passage 3 and the same is introduced into the upstream side of catalyzer 4 for cooling the same. The catalyzer 4 is thereby prevented from the foregoing temperature rise. At this time and simultaneously therewith, the exhaust gas return control valve 22 is also closed and an undue combustion at the time of deceleration is prevented for increasing the unburned components. This is effective for restraining even slightly the temperature rise of the catalyzer 4 and serves to assist the cooling of the catalyzer 4 by the external air introduction.

Thus according to this invention, at the time of deceleration of the engine, external air is introduced into an exhaust passage through an external air introduction passage to be carried to the upstream side of a catalyzer so that the catalyzer is cooled thereby and can be kept at a comparatively low temperature.

The present invention may be embodied in other specific forms without departing from the spirit or essential characteristics thereof. The presently disclosed embodiments are, therefore, to be considered in all respects as illustrative and not restrictive, the scope of the invention being indicated by the appended claims rather than the foregoing description and all changes which come within the meaning and range of equivalency of the claims are, therefore, to be embraced therein.

What is claimed is:

1. An exhaust gas purification apparatus for a lean mixture internal combustion engine comprising:

an intake passage means;

an exhaust passage means;

a catalyzer for exhaust gas purification coupled to said exhaust passage means;

an external air introducing passage means connected to said exhaust passage means on the upstream side of said catalyzer;

a first detecting means connected to said intake passage and operable in response to negative intake pressure above a predetermined value for detecting deceleration of said engine;

a second detecting means operable in response to vehicle speed above a predetermined value; and a control valve means positioned in said external air introducing passage means and connected to said first and second detecting means, whereby said control valve means is opened upon concurrent operation of said first and second detecting means to introduce external air into said exhaust passage means only during deceleration from high speed.

2. An exhaust gas purification apparatus as claimed in claim 1, wherein said second detecting means is operable in response to engine speed above a predetermined value.

3. An exhaust gas purification apparatus as claimed in claim 1, wherein said second detecting means operates when both vehicle speed and engine speed exceed predetermined values.

4. An exhaust gas purification apparatus as claimed in claim 1, wherein said second detecting means operates either when vehicle speed exceeds a certain value or when engine speed exceeds a certain value.

5. An exhaust gas purification apparatus as claimed in claim 1, further comprising an exhaust gas return passage means connected to said intake passage means and to said exhaust passage means, and an exhaust gas return control valve means connected in said exhaust gas return passage means and operable in response to operation of said first and second detecting means to close said exhaust gas return passage means when said first and second detecting means are operated.

6. An exhaust gas purification apparatus for a lean mixture internal combustion engine comprising:

an intake passage means;

an exhaust passage means;

a catalyzer for exhaust gas purification coupled to said exhaust passage means;

an external air introducing passage means coupled to said exhaust passage means on the upstream side of said catalyzer;

a first detecting means comprising a negative pressure responsive valve having a negative pressure chamber connected through a negative pressure passage to said intake passage means for detecting a deceleration of said engine;

an electromagnetic valve positioned in said negative pressure passage;

a solenoid for operating said electromagnetic valve;

a second detecting means comprising a first switch means operable when engine rotation speed is above a predetermined value. a second switch means operable when vehicle speed is above a predetermined value, and an electric source, said first and second switch means being connected between said electric source and said solenoid to operate said electromagnetic valve; and a control valve means positioned in said external air introducing passage means and operated in response to concurrent operation of said negative pressure responsive valve and said electromagnetic valve to introduce external air into said exhaust passage means only during deceleration.

* * * * *